US006318553B1

(12) United States Patent
Deschenes

(10) Patent No.: US 6,318,553 B1
(45) Date of Patent: Nov. 20, 2001

(54) PLASTIC FASTENER AND NEEDLE WELL-SUITED FOR USE IN THE DISPENSING THEREOF

(75) Inventor: Charles L. Deschenes, Attleboro, MA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/626,545

(22) Filed: Jul. 25, 2000

(51) Int. Cl.[7] ..... B65D 85/24
(52) U.S. Cl. ..... 206/343; 206/345
(58) Field of Search ..... 206/338, 343, 206/345, 346; 24/16 PB, 17 AP, 30.5 P

(56) References Cited

U.S. PATENT DOCUMENTS

| | | | | |
|---|---|---|---|---|
| 3,103,666 | | 9/1963 | Bone . | |
| 3,850,297 | * | 11/1974 | Merser | 206/346 |
| 3,872,806 | | 3/1975 | Bone . | |
| 3,990,619 | | 11/1976 | Russell . | |
| 4,039,078 | | 8/1977 | Bone . | |
| 4,456,161 | | 6/1984 | Russell . | |
| 4,462,784 | | 7/1984 | Russell . | |
| 4,533,076 | | 8/1985 | Bourque . | |
| 4,712,677 | * | 12/1987 | Russell | 206/345 |
| 4,901,854 | * | 2/1990 | Bone et al. | 206/343 |
| 5,489,057 | | 2/1996 | Deschenes . | |
| 5,987,719 | * | 11/1999 | Cooper | 206/343 |

* cited by examiner

*Primary Examiner*—David T. Fidei
(74) *Attorney, Agent, or Firm*—Kriegsman & Kriegsman

(57) ABSTRACT

A plastic fastener and a needle particularly well-suited for use in the dispensing of the same. In a preferred embodiment, the plastic fastener includes a stretched flexible filament having a first end and a second end. A first cross-bar is disposed at the first end of the flexible filament, the first cross-bar having a first end and a second end. A second cross-bar is disposed at the second end of the flexible filament, the second cross-bar having a first end and a second end. The second cross-bar is parallel to the first cross-bar. The flexible filament has a first region of increased thickness proximate to the first end of the flexible filament and a second region of increased thickness proximate to the second end of the flexible filament. Each of the first and second regions of increased thickness asymmetrically faces towards the first ends of the cross-bars and faces away from the second ends of the cross-bars. The plastic fastener is preferably of the plastic staple variety and is formed as part of continuously connected fastener stock.

15 Claims, 4 Drawing Sheets

PLASTIC FASTENER AND NEEDLE WELL-SUITED FOR USE IN THE DISPENSING THEREOF

BACKGROUND OF THE INVENTION

The present invention relates generally to the dispensing of plastic fasteners of the type that are used, for example, to attach tags to articles of commerce and relates more particularly to a novel plastic fastener and a needle well-suited for use in dispensing said plastic fastener.

Plastic fasteners of the type comprising an elongated flexible filament having a first cross-bar at one end and a second cross-bar (or other enlargement, such as a paddle or a knob) at the opposite end are well-known and have been widely used in a variety of applications, such as in the attachment of merchandise tags to articles of commerce, in the attachment of buttons to garments, in the lasting of shoes, and in various packaging applications. Typically, such plastic fasteners are mass-produced by molding processes into either one of two different types of assemblies. One such assembly, an example of which is disclosed in U.S. Pat. No. 3,103,666, inventor Bone, issued Sep. 17, 1963 (which patent is incorporated herein by reference), is a clip-type assembly, said clip comprising a plurality of fasteners, each such fastener comprising a flexible filament having a first cross-bar at one end thereof and a paddle or second cross-bar at the opposite end thereof. The fasteners are arranged in a spaced, side-by-side orientation, with the respective first cross-bars parallel to one another and the respective paddles or second cross-bars parallel to one another, each of the first cross-bars being joined to a common, orthogonally-disposed runner bar by a severable connector. Adjacent second cross-bars or paddles also may be interconnected by severable connectors extending therebetween.

The aforementioned fastener clip is typically made by injection molding, the filament portions of the fasteners typically being stretched after molding to bring the filaments to their desired lengths and to strengthen the filaments by orienting the molecules therein along a common axis. Several commercial embodiments of the above-described fastener clip have been sold by the present assignee, Avery Dennison Corporation, as DENNISON®SWIFTACH®fastener clips.

A second type of fastener assembly, an example of which is disclosed in U.S. Pat. No. 4,533,076, inventor Bourque, issued Aug. 6, 1985 (which patent is incorporated herein by reference), is known as continuously connected fastener stock. In one type of continuously connected stock, the fasteners comprise a flexible filament having a cross-bar at one end thereof and a paddle (or second cross-bar) at the opposite end thereof, the respective cross-bars and paddles of successive fasteners being arranged end-to-end and being joined together by severable connectors. In another type of continuously connected fastener stock, the fastener stock is formed from two elongated and continuous side members coupled together by a plurality of equidistantly-spaced cross-links. Individual fasteners having an H-shape, often referred to as "plastic staples," are dispensed from the fastener stock by cutting the side members at appropriate points between crosslinks.

Continuously connected fastener stock is typically made by a rotary extrusion process of the type disclosed in U.S. Pat. No. 4,462,784, inventor Russell, which issued Jul. 31, 1984, and which is incorporated herein by reference. Said rotary extrusion process typically involves the use of a rotating molding wheel whose periphery is provided with molding cavities that are complementary in shape to the desired fastener stock. To form fasteners, plastic is extruded into the cavities of the molding wheel, and a knife in substantially elliptical contact with the wheel is used to skive the molded plastic from the molding wheel. Following molding, the filament portions of the fasteners are typically stretched to achieve their desired lengths and to strengthen the filaments.

Tools (often referred to as "tagging guns" or "fastener attaching tools") for dispensing individual fasteners from runner bar-containing clips or from continuously connected fastener stock above are known, examples of such tools being disclosed in the following U.S. patents, all of which are incorporated herein by reference: U.S. Pat. No. 4,039,078, inventor Bone, which issued Aug. 2, 1977; U.S. Pat. No. 5,433,366, inventors Deschenes et al., which issued Jul. 18, 1995; U.S. Pat. No. 4,121,487, inventor Bone, which issued Oct. 24, 1978; U.S. Pat. No. 5,320,269, inventors Deschenes et al., which issued Jun. 14, 1994; U.S. Pat. No. 4,955,475, inventors McCarthy et al., which issued Sept. 11, 1990; U.S. Pat. No. 4,456,161, inventor Russell, which issued Jun. 26, 1984; U.S. Pat. No. 5,024,365, inventor Bourque, which issued Jun. 18, 1991; and U.S. Pat. No. 4,998,661, inventors Deschenes et al., which issued Mar. 12, 1991.

Such tools typically comprise a needle, the needle typically including a stem portion. The stem portion typically is generally cylindrical in shape and has a tip adapted for insertion into an article of commerce. In addition, the stem portion has a longitudinal cylindrically-shaped bore adapted to receive the first cross-bar of a fastener. In addition, said stem portion also typically has a longitudinal slot adapted to permit the filament portion of a fastener to extend therethrough while the first cross-bar of the fastener is disposed in the longitudinal bore of the stem portion. During penetration of an article by the fastener cross-bar, the filament is bent rearwardly and approximately parallel to the longitudinal axis of the cross-bar, causing a rearwardly-facing bulge or arc of filament to extend from the cross-bar until the latter is ejected from the needle. As a result, another purpose served by the longitudinal slot of the needle is to receive the aforementioned rearwardly-facing bulge of filament and to keep said bulge from coming into contact with the article, where damaging stresses can be created on the filament and/or the article.

The needle also may include a base portion, said base portion being attached to the rear of the stem portion and being adapted to be removably received in the tool. The stem portion and the base portion may be a unitary structure or, as is more often the case, the base portion is insert molded onto the rear end of the stem portion.

Such tools also typically comprise an ejector rod for ejecting a first cross-bar from the needle and into the article of commerce and may also include a knife or similar severing means for cutting the severable connector between the first cross-bar being dispensed and its adjacent first cross-bar and feeding means for advancing the assembly of fasteners in the tool so as to align the forward most first cross-bar with the needle.

One problem that has been noted by the present inventors is that certain fasteners do not have a tensile strength that is as great as desired for certain applications. This problem is more familiar in the case of, but not exclusive to, plastic staples, which are typically made of polyurethane and typically have a tensile strength of about 1.2–1.4 pounds.

SUMMARY OF THE INVENTION

It is an object of the present invention to provide a new plastic fastener of the type comprising a flexible filament and a cross-bar disposed at a first end thereof.

It is another object of the present invention to provide a plastic fastener as described above that overcomes at least some of the problems described herein with respect to existing plastic fasteners.

The present invention is based, in part, on the present inventors' recognition that, when subjected to sufficient tensile stress, plastic fasteners of the type comprising a stretched flexible filament having a cross-bar disposed at a first end thereof frequently break in or around the juncture of the filament and the cross-bar, and that this phenomenon is explainable, at least in part, by the fact that the filamentary material located in or around the juncture is not stretched, during manufacture, to the same extent as is filamentary material located distal to said juncture. As a result, the filamentary material located in or around the juncture is not as strong as that located distal to said juncture.

Therefore, in order to provide a filament/cross-barjuncture of increased strength, the present inventors herein disclose a plastic fastener wherein the thickness of the filament in the area of the juncture is increased. However, said increase in thickness is not symmetrical about a plane extending parallel to the length of the filament and perpendicular to the length of the cross-bar; instead, the thickness of the filament at its intersection with the cross-bar is greater in the direction of the leading end of the cross-bar than it is in the direction of the trailing end of the cross-bar. The reason for this asymmetry is an accommodation between the aforementioned desire to achieve greater filament strength and the opposing desire to ensure that the cross-bar is given sufficient freedom to pivot to permit its being dispensed with a tool in the conventional manner. In other words, if the thickness were increased symmetrically about the aforementioned plane, the cross-bar may not be free to pivot sufficiently to be dispensed.

It is still another object of the present invention to provide a needle that is particularly wellsuited for use in dispensing plastic fasteners of the type described above.

As noted above, when a conventional fastener is attached to an article, a rearwardly-facing bulge of filament extends from the cross-bar during penetration of the article by the cross-bar. Because the plastic fastener of the present invention includes an asymmetric area of increased thickness in the vicinity of the filament/cross-bar juncture, the rearwardly-facing bulge or arc of filament for the present fastener extends higher away from the top of the cross-bar than does a corresponding bulge for a conventional fastener. In fact, said bulge or arc of filament for the present fastener extends so high from the top of the cross-bar that it cannot be completely received in and adequately protected by the longitudinal slot of the needle.

Therefore, according to one feature of the invention, there is provided a needle that is particularly well-suited for use in dispensing the plastic fastener of the present invention, said needle differing from conventional needles in that it includes a stem portion having a slot of increased depth. Preferably, said slot is sufficiently deep to completely receive the rearwardly-facing bulge of filament for the present fastener. Said slot of increased depth is achieved, according to one embodiment, by shaping the stem so as to terminate in a tip at the front end thereof and so as to include a body and a neck, said neck extending away from said body, said body defining a longitudinally-extending bore being dimensioned to receive the cross-bar, said body and said neck together defining the longitudinally-extending slot of increased depth.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
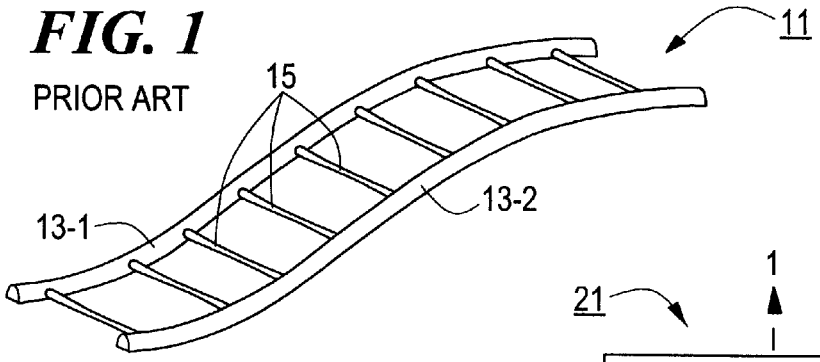
FIG. 1 PRIOR ART
FIG. 1 is a perspective view of a length of conventional continuously connected fastener stock of the plastic staple variety.

Referring now to FIG. 1, there is shown a perspective view of a length of conventional continuously connected fastener stock of the plastic staple variety, said length of fastener stock being represented generally by reference numeral 11.

Fastener stock 11, which is made by the above-described rotary extrusion method and whose filaments are thereafter stretched, comprises two elongated and continuous side members 13-1 and 13-2. Side members 13-1 and 13-2 are coupled together by a plurality of equidistantly-spaced, flexible cross-links or filaments 15. By cutting side members 13-1 and 13-2 at appropriate points between cross-links 15, individual fasteners having an H-shape, often referred to as "plastic staples," are produced.

Figure 2:
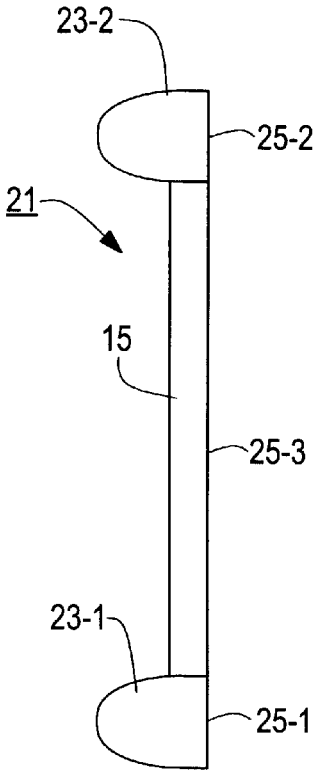
FIG. 2 PRIOR ART
FIG. 2 is an enlarged end view of an individual plastic staple obtained from the length of conventional continuously connected fastener stock of FIG. 1.

Referring now to FIG. 2, there is shown an enlarged end view of an individual plastic staple obtained in the aforementioned manner from a length of fastener stock 11, the individual plastic staple being represented generally by reference numeral 21.

Staple 21 comprises a first cross-bar 23-1, which has been cut from side member 13-1, and a second cross-bar 23-2, which has been cut from side member 13-2, cross-bars 23-1 and 23-2 being interconnected by flexible filament 15. As can be seen, due to the rotary extrusion process by which stock 11 is formed, cross-bars 23-1 and 23-2 and filament 15 are flat on sides 25-1, 25-2 and 25-3, respectively, sides 25-1, 25-2 and 25-3 being coplanar with one another. As a result, as can be seen, cross-bar 23-1 and filament 15 collectively have a generally "d"-shape.

Figure 3:
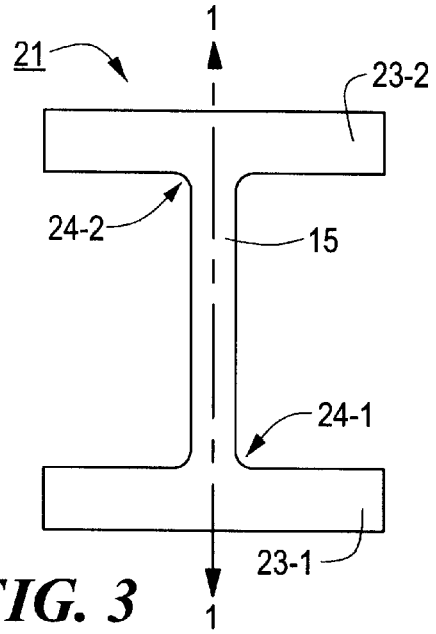
FIG. 3 PRIOR ART
FIG. 3 is an enlarged front view of the plastic staple of FIG. 2.

Referring now to FIG. 3, there is shown an enlarged front view of plastic staple 21. As can be seen, both the juncture 24-1 of filament 15 and cross-bar 23-1 and the juncture 24-2 of filament 15 and cross-bar 23-2 are substantially symmetrical with respect to a line 1-1 drawn parallel to the longitudinal axis of filament 15 and perpendicular to the longitudinal axes of cross-bars 23-1 and 23-2.

Figure 4:
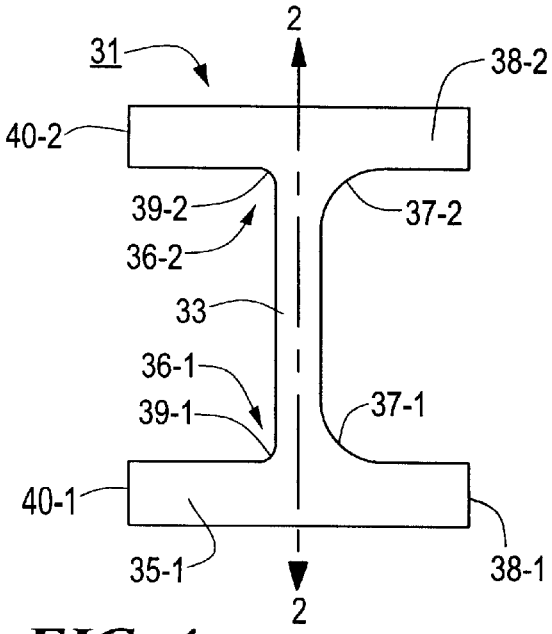
FIG. 4 PRIOR ART
FIG. 4 is an enlarged front view of one embodiment of a plastic fastener constructed according to the teachings of the present invention.

Referring now to FIG. 4, there is shown an enlarged front view of one embodiment of a plastic fastener constructed according to the teachings of the present invention, said plastic fastener being represented generally by reference numeral 31.

Fastener 31, which is similar in many respects to staple 21, is a unitary structure shaped to include a stretched flexible filament 33, a first cross-bar 35 disposed at one end of filament 33, and a second cross-bar 37 disposed at the opposite end of filament 33. Fastener 31 differs notably from staple 21 in that the juncture 36-1 of filament 15 and cross-bar 35-1 and thejuncture 36-2 of filament 15 and cross-bar 35-2 are substantially asymmetrical with respect to a line 2-2 drawn parallel to the longitudinal axis of filament 33 and perpendicular to the longitudinal axes of cross-bars 35-1 and 35-2. In particular, the radii of curvature of ends 37-1 and 37-2 of junctures 36-1 and 36-2, respectively, are greater than the corresponding radii of curvature of ends 39-1 and 39-2. In other words, although filament 33 increases in thickness at its ends relative to the remainder of its length, it does not increase symmetrically with respect to its longitudinal axis, but rather, increases more in the direction of ends 38-1 and 38-2 of cross-bars 35-1 and 35-2, respectively, and increases less in the direction of ends 40-1 and 40-2 of cross-bars 35-1 and 35-2, respectively.

It should be understood that, whereas both junctures 36-1 and 36-2 of fastener 31 are asymmetric, it is within the scope of the present invention for only one of junctures 36-1 and 36-2 to be asymmetric.

Figure 5:
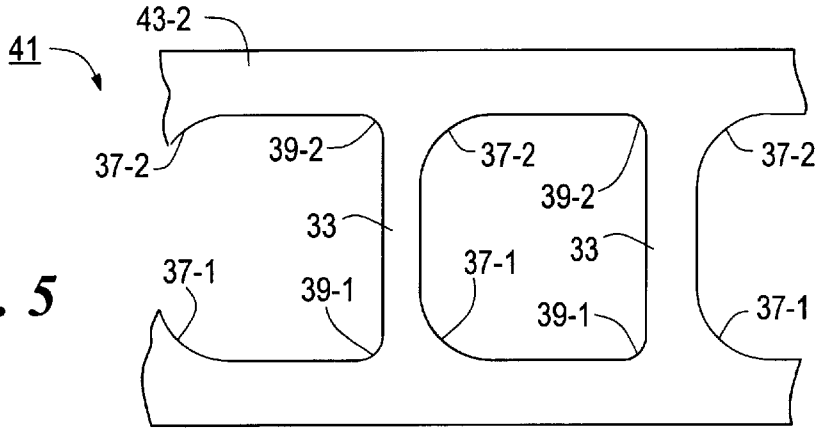
FIG. 5 is an enlarged front view of a length of continuously connected fastener stock comprising a plurality of the fasteners of FIG. 4.

Fastener 31 can be, but is not limited to being, a fastener of the plastic staple variety formed as part of continuously connected fastener stock. FIG. 5 shows a length of continuously connected fastener stock 41 from which fastener 31 can be obtained, stock 41 comprising a pair of elongated and continuous side members 43-1 and 43-2 coupled together by a plurality of filaments 33.

Figure 6:
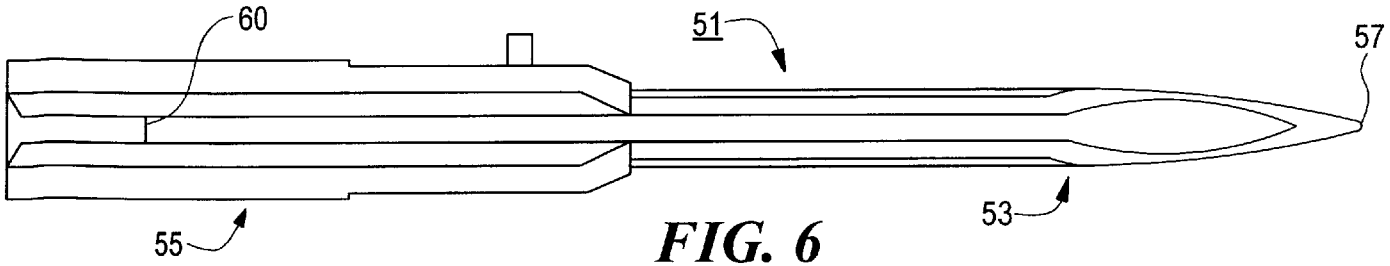
FIG. 6 is a top view of a conventional needle adapted for use in dispensing fasteners, such as the plastic staple of FIG. 2.
Figure 7:
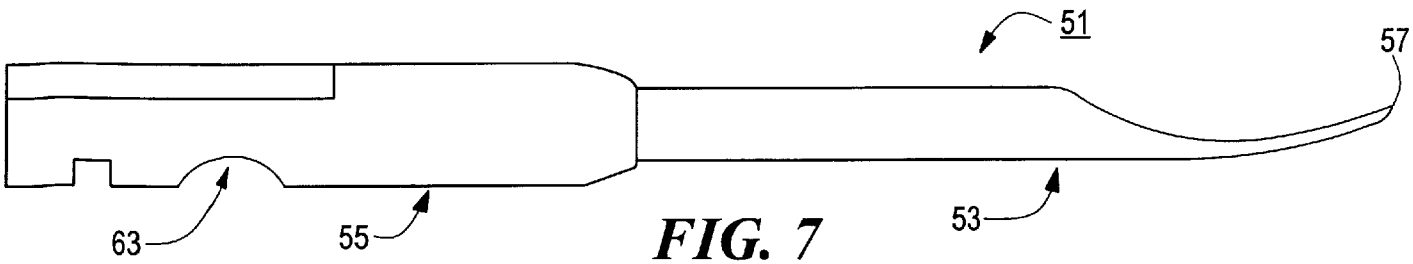
FIG. 7 is a left side view of the needle shown in FIG. 6.

Referring now to FIGS. 6 and 7, there are shown side and top views, respectively, of a conventional needle adapted for use in dispensing fasteners, such as the plastic staple of FIG. 2, said needle being represented generally by reference numeral 51.

Needle 51 comprises a stem portion 53 and a base portion 55. Stem portion 53 may be made, for example, by stamping and rolling or by machining a piece of metal (e.g., stainless steel) or by the electroforming/machining technique described in U.S. Pat. No. 5,489,057, inventor Deschenes, issued Feb. 6, 1996, the disclosure of which is incorporated herein by reference.

Figure 8:
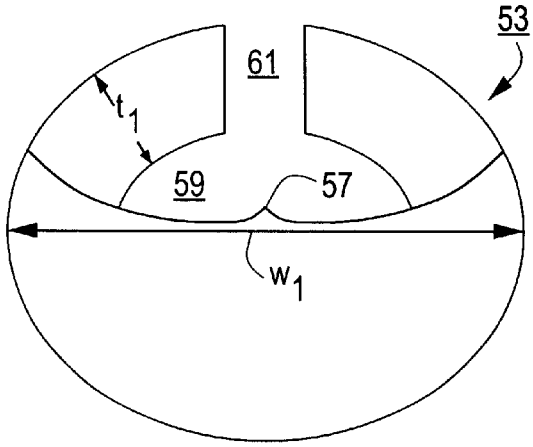
FIG. 8 is a front view of the stem portion of the needle shown in FIG. 6.

Referring now to FIGS. 6 through 8, stem portion 53 can be seen to be an elongated member that is substantially cylindrical over most of its length (and annular in transverse cross-section). The front end of stem portion 53 is formed into a spoon-shaped tip 57, tip 57 being sufficiently sharp to enable its penetration into a desired article of commerce. A generally cylindrical bore 59 extends longitudinally across substantially the entire length of stem portion 53. Bore 59 is appropriately dimensioned to receive a cross-bar of a plastic fastener, such as cross-bar 23-1 of plastic staple 21. Stem portion 53 is also shaped to include a slot 61 extending longitudinally across substantially the entire length of stem portion 53, longitudinal slot 61 being appropriately dimensioned to permit a filament, such as filament 15, to extend therethrough while its associated cross-bar is disposed within bore 59. In addition, as noted above, slot 61 is suitably sized so as to receive the rearwardly-facing bulge of filament 15 while cross-bar 23-1 is being inserted through an article.

A conventional stamped and rolled stainless steel stem portion 53 used in the dispensing of plastic staples 21 typically has a width $w_1$ of about 0.065 inch and a cross-sectional thickness $t_1$ of about 0.008–0.010 inch.

Referring back to FIGS. 6 and 7, base portion 55 is made in the conventional manner by insert-molding plastic onto the rear end 60 of stem portion 53. Base portion 55, which is generally cylindrical in shape, includes a generally cylindrically-shaped longitudinal bore aligned with (and sized similarly to) bore 59 of stem portion 53 and also includes a longitudinal slot aligned with (and sized similarly to) slot 61 of stem portion 53. Base portion 55 is provided with a recessed area 63 for use in correctly positioning needle 51 within a fastener dispensing tool and for locking the same into place.

Figure 9:
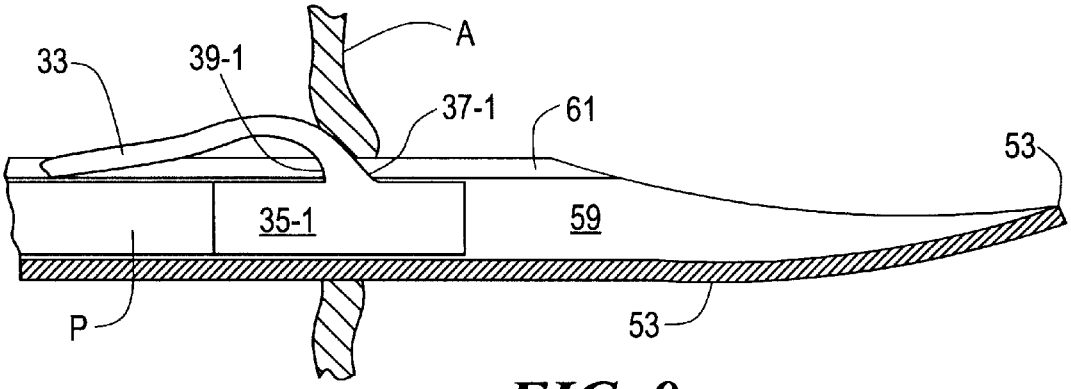
FIG. 9 is a section view illustrating the insertion of the plastic fastener of FIG. 4 through an article using the needle of FIG. 6.

Referring now to FIG. 9, there is shown a fragmentary section view illustrating the attachment of fastener 31 to an article of commerce A using needle 51. As can be seen, fastener 31 has its cross-bar 35-1 inserted into bore 59 of stem portion 53, with filament 33 extending outwardly through slot 61. Tip 57 of stem portion 53 is inserted through article A, and a plunger P is engaged with cross-bar 35-1 to eject cross-bar 35-1 from stem portion 53 and to push cross-bar 35-1 through article A.

As can be seen, because of the shape of filament 33 at its juncture with cross-bar 35-1, a rearwardly-facing bulge of filament 33 is formed that cannot be contained entirely within slot 61, said bulge directly contacting article A. Such contact is undesirable as it can cause damage to article A and/or filament 33.

Figure 10:
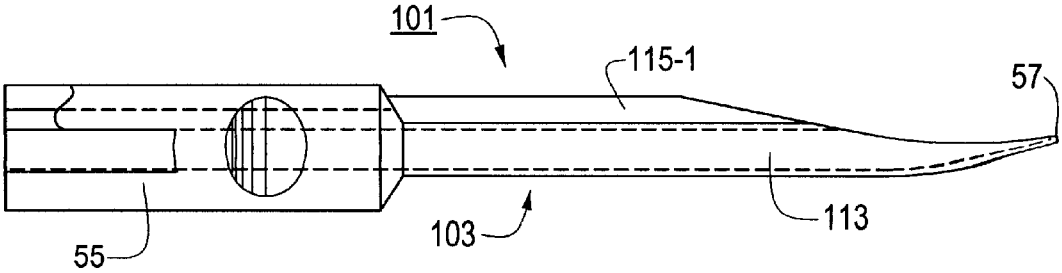
FIG. 10 is a left side view of one embodiment of a needle constructed according to the teachings of the present invention.

Referring now to FIG. 10, there is shown a side view of a needle particularly well-suited for use in dispensing plastic fasteners, such as fastener 31, said needle being represented generally by reference numeral 101.

Needle 101 comprises a stem portion 103 and a base portion 105. Base portion 105, which is identical in all respects to base portion 55, may be made by insert-molding plastic onto the rear end of stem portion 103.

Figure 11:
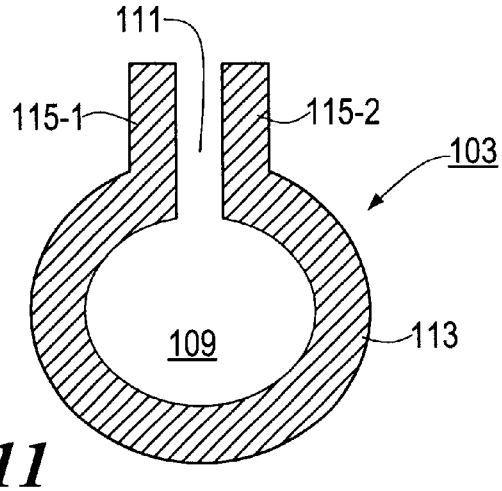
FIG. 11 is a transverse section view of the stem portion of the needle of FIG. 10.

Referring now to FIGS. 10 and 11, stem portion 103 is similar in certain respects to stem portion 53. For example, stem portion 103 is an elongated member terminating at its front end in a spoon-shaped tip 107, tip 107 being sufficiently sharp to enable its penetration into a desired article of commerce. In addition, stem portion 103 is shaped to include a generally circular bore 109 and a generally rectangular slot 111, bore 109 and slot 111 communicating with one another and extending longitudinally across substantially the entire length of stem portion 103. Stem portion 103 differs from stem portion 53 in that stem portion 103 is shaped to include an annularly-shaped body 113 and a neck or pair of flanges 115-1 and 115-2 extending away from body 113, bore 109 being bounded by body 113, slot 111 being defined by the combination of body 113 and flanges 115-1 and 115-2. In this manner, whereas stem portion 53 is generally annular in transverse cross-section, stem portion 103 is generally lollipop-shaped.

Figure 12:
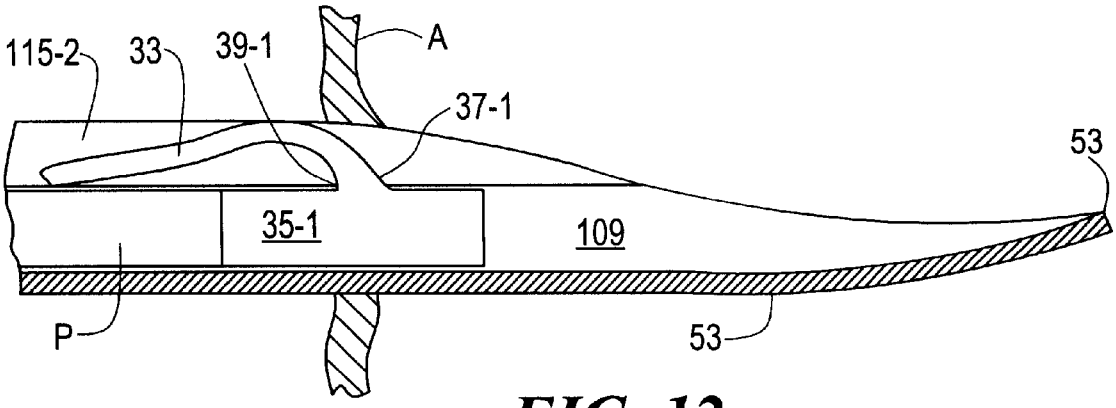
FIG. 12 is a section view illustrating the insertion of the plastic fastener of FIG. 4 through an article using the needle of FIG. 10.

Bore 109 is appropriately dimensioned to receive a cross-bar of a plastic fastener, such as cross-bar 35-1 of plastic staple 31, and slot 111 is appropriately dimensioned to permit a filament, such as filament 33, to extend therethrough while its associated cross-bar is disposed within bore 109. Moreover, as shown in FIG. 12, slot 111 is sufficiently deep to receive the rearwardly-facing bulge of filament 33 when cross-bar 35 penetrates article A so as to keep said bulge from directly contacting article A.

Stem portion 103 may be made by any of the same techniques discussed above in connection with the fabrication of stem portion 53; however, the above-described electroforming/machining technique is preferred. Said electroforming step is preferably performed using a suitably shaped master (e.g., an inverted lollipop-shaped master) and preferably involves depositing a boron/nickel alloy onto the master to a substantially uniform thickness of about 0.003–0.005 inch.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A plastic fastener comprising:

(a) a flexible filament, said flexible filament having a first end; and (b) a first cross-bar disposed at said first end of said flexible filament, said first cross-bar having a first end and a second end;

(c) wherein said flexible filament has a first region of increased thickness proximate to said first end of said flexible filament, said first region of increased thickness asymmetrically facing towards said first end of said first cross-bar and facing away from said second end of said first cross-bar.

2. The plastic fastener as claimed in claim 1 wherein said flexible filament is a stretched flexible filament.

3. The plastic fastener as claimed in claim 1 wherein each of said flexible filament and said first cross-bar has a flat side, said flat sides of said flexible filament and said first cross-bar being coplanar.

4. The plastic fastener as claimed in claim 1 wherein said flexible filament has a second end, said plastic fastener further comprising a second cross-bar disposed at said second end of said flexible filament, said second cross-bar being parallel to said first cross-bar and having a first end and a second end, said first end of said second cross-bar facing in the same direction as said first end of said first cross-bar.

5. The plastic fastener as claimed in claim 4 wherein said flexible filament has a second region of increased thickness, said second region being located proximate to said second end of said flexible filament, said second region asymmetrically facing towards said first end of said second cross-bar and facing away from said second end of said second cross-bar.

6. The plastic fastener as claimed in claim 6 wherein each of said flexible filament, said first cross-bar and said second cross-bar has a flat side, said flat sides of said flexible filament, said first cross-bar and said second cross-bar being coplanar.

7. A fastener assembly comprising an interconnected plurality of the plastic fasteners of claim 1.

8. A fastener assembly comprising:

(a) a first elongated member, said first elongated member having a first end and a second end;

(b) a second elongated member, said second elongated member being parallel to said first elongated member and having a first end and a second end, said first end of said second elongated member facing in the same direction as said first end of said first elongated member; and (c) a plurality of filaments, each of said filaments having a first end connected to said first elongated member and a second end connected to said second elongated member;

(d) wherein each of said flexible filaments has a first region of increased thickness proximate to said first end of said flexible filament, said first region of increased thickness asymmetrically facing towards said first ends of said first and second elongated members and facing away from said second ends of said first and second elongated members.

9. The fastener assembly as claimed in claim 8 wherein said fastener assembly is continuously connected plastic staple fastener stock.

10. The fastener assembly as claimed in claim 8 each of said flexible filaments has a second region of increased thickness proximate to said second end of said flexible filament, said second region of increased thickness asymmetrically facing towards said first ends of said first and second elongated members and facing away from said second ends of said first and second elongated members.

11. A plastic fastener comprising:

(a) a flexible filament, said flexible filament having a first end and a length; and (b) a first cross-bar transversely disposed at said first end of said flexible filament, said first cross-bar having a first end, a second end and a length extending from said first end to said second end;

(c) wherein said flexible filament is asymmetric in thickness about a plane extending parallel to the length of said flexible filament and perpendicular to the length of said first cross-bar.

12. The plastic fastener as claimed in claim 11 wherein said asymmetry in thickness includes a first region of increased thickness disposed proximate to said first end of said flexible filament.

13. The plastic fastener as claimed in claim 11 further comprising a second cross-bar, said second cross-bar being transversely disposed at said second end of said flexible filament and being parallel to said first cross-bar.

14. The plastic fastener as claimed in claim 13 wherein said asymmetry in thickness includes a first region of increased thickness disposed proximate to said first end of said flexible filament and a second region of increased thickness disposed proximate to said second end of said flexible filament.

15. A plastic fastener comprising:

(a) a flexible filament, said flexible filament having a first end;

(b) a cross-bar, said cross-bar having a first end, a second end and a length extending from said first end to said second end;

(c) wherein said cross-bar and said filament are transversely joined together at said first end of said flexible filament to form a joint, said joint having a first radius of curvature facing towards said first end of said cross-bar and a second radius of curvature facing towards said second end of said cross-bar, said first and second radii of curvature being unequal.

* * * * *